US006105403A

United States Patent [19]

Carow, Jr. et al.

[11] Patent Number: 6,105,403

[45] Date of Patent: Aug. 22, 2000

[54] LID SEAL FOR AN AUTOMATIC WASHER

[75] Inventors: James Phillips Carow, Jr., St. Joseph; Kevin Gene Schneider, Benton Harbor, both of Mich.

[73] Assignee: Whirlpool Corporation, Benton Harbor, Mich.

[21] Appl. No.: 09/231,412

[22] Filed: Jan. 14, 1999

[51] Int. Cl.[7] ..... D06F 39/14

[52] U.S. Cl. ..... 68/196; 220/849

[58] Field of Search ..... 68/196; 220/849

[56] References Cited

U.S. PATENT DOCUMENTS

| | | | |
|---|---|---|---|
| 2,254,003 | 8/1941 | De Marco | 68/196 |
| 2,315,604 | 4/1943 | Ebert | 68/196 X |
| 2,324,333 | 7/1943 | Stoddard | 220/849 |
| 2,657,475 | 11/1953 | Erickson | 220/849 X |
| 3,608,339 | 9/1971 | Mazza | 68/196 X |

FOREIGN PATENT DOCUMENTS

| | | | |
|---|---|---|---|
| 1008698 | 5/1957 | Germany | 68/196 |

*Primary Examiner*—Philip R. Coe

*Attorney, Agent, or Firm*—Thomas J. Roth; Joel M. Van Winkle; Robert O. Rice

[57] ABSTRACT

A lid seal for an automatic vertical axis washer. The lid seal includes rigid and flexible components and generally attaches to a flange of the lid along at least a portion of a lid periphery. When the lid is closed, the lid seal engages the washer housing to eliminate or greatly reduce operational noise and wash fluid spray from escaping through gaps between the lid and the washer housing. In addition, the lid seal acts to improve lid closure sound quality. In doing so, the user is provided with a simple and low cost method to reduce noise and wash fluid spray nuisances associated with the operation of an automatic vertical axis washer.

18 Claims, 2 Drawing Sheets

70
58
66
76
81
80
50
60
62
68
64
74
79
78
72
84
82
36
38
94
24
52
46
92
42
48
44
110
108
104
106
96
102
98
100
34
32
30
28
26
22
14

LID SEAL FOR AN AUTOMATIC WASHER

BACKGROUND OF THE INVENTION

The present invention generally relates to an automatic vertical axis clothes washer. More particularly the present invention is directed to an automatic vertical axis clothes washer having a lid seal extending along at least a portion of the periphery of the lid of the washer.

Door seals are generally known for automatic horizontal rather than vertical axis washers. In such applications, the door seal is needed to prevent water release to the outside environment due to the fact that the door is at least partially submerged during operation. In addition, door seals have been applied to automatic clothes dryers. In such application, the door seal acts to prevent lint from circumventing the lint filter system and being released to the surrounding environment. Door seals are also necessary to prevent the loss of a pressure differential between the interior of the dryer drum and the ambient atmosphere. Moreover, the door seal creates a barrier to the surrounding air in order to maintain efficient heating during dryer operation.

In contrast, a lid seal previously has not been applied to the automatic vertical axis clothes washer. The need to prevent air, water, or lint release has not previously existed in the automatic vertical axis washer exhibiting a traditional deep water fill for washing and rinsing cycles. However, the traditional automatic vertical axis washer does present other needs to which the lid seal may be applied. In addition, some vertical axis washers are now operating in non-traditional manners creating noise and water spray disturbances that did not previously occur. First, there exists a need to reduce operational noise levels from escaping from gaps between the lid and all types of washers when the lid is closed. Noise released to the surrounding environment creates a nuisance for the user. A particular example of an unpleasant sound for the user is the high frequency splash associated with a concentrated or reduced water level wash cycle. Moreover, the need arises in all types of washers to improve lid closure sound quality. The lid is generally dropped into its closed position. As a result, the lid and washer contact to generate a metallic ringing noise. This noise is also unpleasant and, thus, creates a nuisance for the user. Lastly, there exists a need in non-traditional vertical axis washers, namely washers having a low or concentrated water wash cycle, to reduce wash fluid spray from escaping from gaps between the lid and washer when the lid is closed. During operation, the surrounding environment is unprotected from the wash fluid spray as it escapes from gaps between the lid and washer. Thus, wash fluid spray may contact the surrounding environment and create an additional nuisance for the user.

Presently, the standard use of lid bumpers is an ineffective means to reduce operational noise levels or wash fluid spray from escaping from gaps between the lid and washer or to improve lid closure sound quality in automatic vertical axis washers. Regarding the reduction of operational noise or wash fluid spray, lid bumpers are ineffective because lid bumpers generally are only located at two specific locations along the washer top wall. When the lid is closed, it rests on the lid bumpers. In this position, there exists a gap between the lid and washer. This gap essentially extends along the entire periphery of the lid. During operation, the lid bumpers provide little, if any, means to prevent the escape of the operational noise levels or wash fluid spray because the gap between the lid and washer is so extensive. Moreover, lid bumpers are an ineffective means to improve lid closure sound quality because the specific positioning of lid bumpers provides only minimal support to absorb the contact force between the lid and the washer when the lid is dropped into its closed position. Therefore, it would be an advance in the art if there were provided an apparatus that would reduce operational noise levels or prevent wash fluid spray from escaping from gaps between the lid and washer or improve lid closure sound associated with the operation of an automatic vertical axis washer.

SUMMARY OF THE INVENTION

An automatic vertical axis clothes washer is provided having a lid seal extending along at least a portion the periphery of the lid. In a preferred embodiment, the lid seal generally has a rigid and flexible component. However, the seal could be provided as a single flexible member. The rigid and flexible components are each extruded and can easily be assembled to each other without additional fasteners. The rigid component can be formed of nylon or other material with similar rigid qualities, and the flexible component can be formed of PVC or other material with similar flexible and resilient characteristics.

In operation, the lid seal provides an effective means to reduce operational noise levels or wash fluid spray from escaping to the surrounding environment and to improve lid closure sound quality. The lid seal effectively reduces operational noise levels or wash fluid spray because it eliminates or greatly reduces gaps between the lid and washer surface when the lid is closed. Gaps are eliminated because the lid seal extends along at least a portion of the periphery of the lid. The lid seal also includes rigid and flexible components that act together to provide an effective barrier to operational noise or wash fluid spray. The rigid component firmly secures the lid seal to the lid. The flexible component contacts the washer when the lid is placed in a closed position. In doing so, this flexible component compresses to form to the washer thereby ultimately eliminating or greatly reducing space between the lid and the washer.

Furthermore, both the fact that the lid seal extends along at least a portion of the periphery of the lid and the fact that it has rigid and flexible components make the lid seal an effective means to improve lid closure sound quality. When the lid is dropped into its closed position, the lid seal acts to deaden the metallic ringing noise generated from contact between the lid and washer. This noise is effectively reduced because the lid seal acts to distribute the contact force along the entire length of the lid seal that extends along at least a portion of the periphery of the lid. In addition, the lid seal also acts to cushion the contact due to the fact that it is compressible and resiliently forms to the washer.

In an embodiment, a lid seal is provided for an automatic vertical axis washer wherein the washer has a housing, a housing top, and a lid, having a lid periphery. The lid seal is securable to the lid extending along at least a portion of the lid periphery.

In another embodiment, a lid seal is provided for an automatic vertical axis clothes washer wherein the washer has a housing, a housing top, and a lid, having a lid periphery, a front lid flange, and a rear lid flange. In turn, the lid seal includes a front lid seal attachable to the front lid flange and a rear lid seal attachable to the rear lid flange. Both the front lid seal and rear lid seal extend along at least a portion of the lid periphery.

In a further embodiment, a lid seal is provided for an automatic vertical axis clothes washer wherein the washer has a housing, a housing top, and a lid, having a lid periphery, a front lid flange, and a rear lid flange. The lid seal includes a front lid seal having a front lid seal clip connected to a front lid seal bulb and a rear lid seal having a rear lid seal clip connected to a rear lid seal bulb. The front lid seal clip is securable to the front lid flange, and the rear lid seal clip is attachable to the rear lid flange. Both the front lid seal and the rear lid seal extend along at least a portion of the lid periphery.

In a related embodiment, the front lid flange is barbed in shape.

In another related embodiment, the front lid seal clip and rear lid seal clip are rigid to firmly attach to the lid flange.

In a further related embodiment, the front lid seal bulb and rear lid seal bulb are flexible and resilient to effectively eliminate or greatly reduce gaps between the lid and the automatic vertical axis washer when the lid is closed.

It is, therefore, an advantage of the present invention to provide a lid seal for an automatic vertical axis washer which acts to eliminate or greatly reduce gaps between the lid and the automatic vertical axis washer to reduce operational noise or wash fluid spray from escaping during operation.

Another advantage of the present invention is to provide a lid seal which improves the lid closure sound quality to effectively distribute and cushion the contact between the lid and the automatic vertical axis washer when the lid is dropped into its closed position.

Additional features and advantages of the present invention are described in, and will be apparent from, the detailed description of the presently preferred embodiments.

DETAILED DESCRIPTION OF THE PRESENTLY PREFERRED EMBODIMENTS

Figure 1:
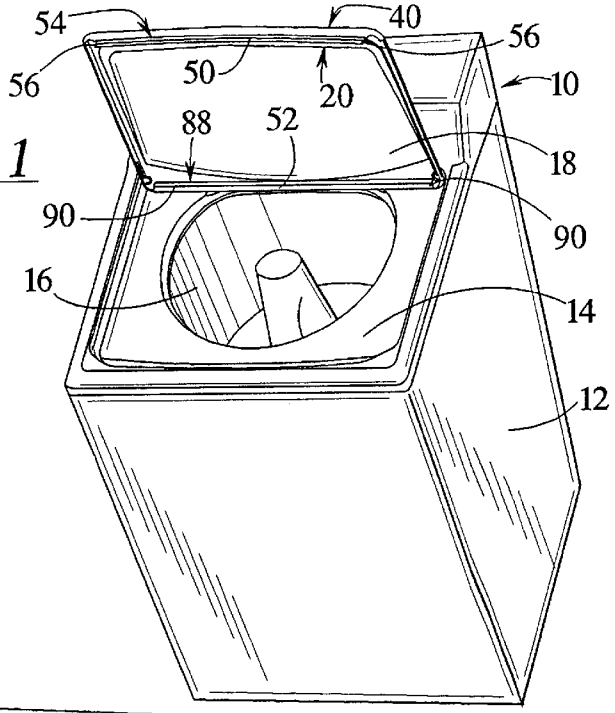
FIG. 1 illustrates a perspective view of an automatic vertical axis washer embodying features of the present invention.

FIG. 1 generally illustrates the external components of an automatic vertical axis washer 10 embodying features of the present invention. The washer 10 includes a housing 12, a housing top 14 defining an opening 16, a lid 18 for covering the opening 16, and a lid seal 20.

Figure 3:
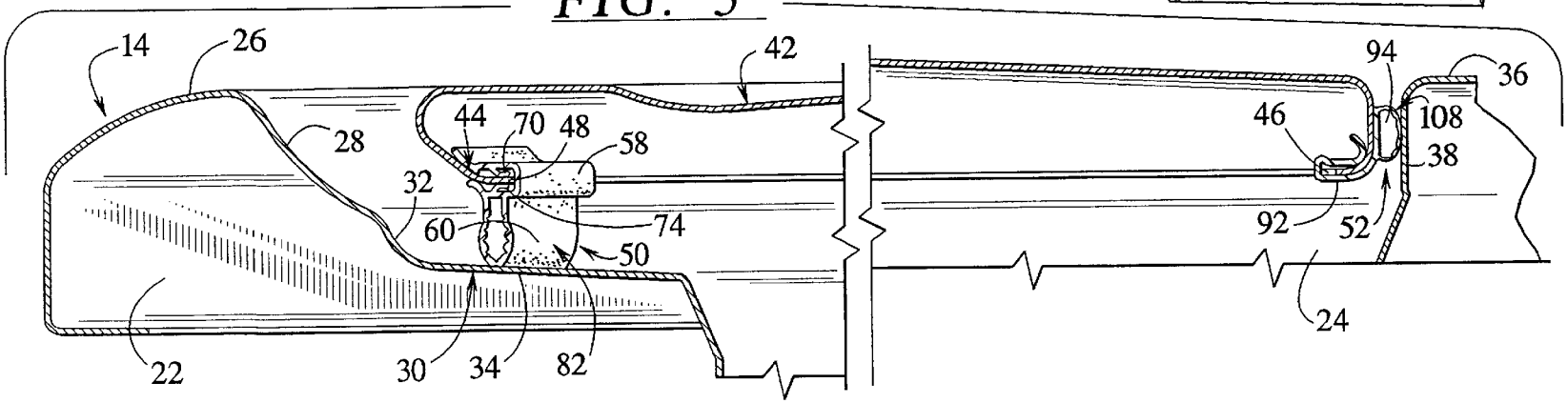
FIG. 3 illustrates a side sectional view of the automatic vertical axis washer lid with front and rear lid seals and a washer lid in a closed position according to an embodiment of the invention.
Figures 2, 4, 6:
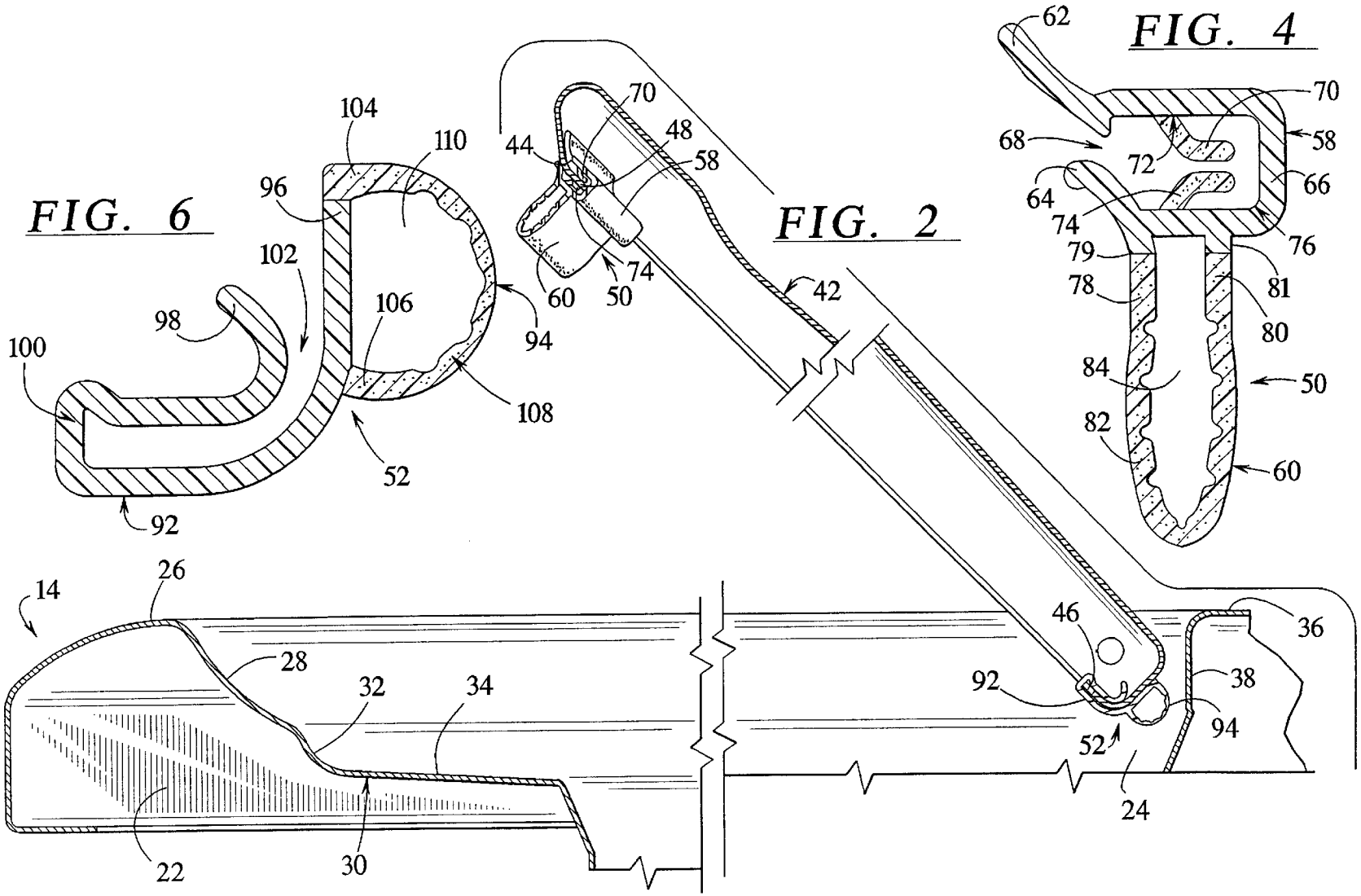
FIG. 2 illustrates a side sectional view of the automatic vertical axis washer lid with front and rear lid seals and a washer lid in an opened position according to an embodiment of the present invention.
FIG. 4 illustrates a side sectional view of a front lid seal.
FIG. 6 illustrates a side sectional view of a rear lid seal.

The housing top 14 is generally annular, having an at least partially rounded interior area defining the opening 16. The housing top 14 generally forms an upper surface of the automatic vertical axis washer 10 which is predominately covered by the lid 18. The lid 18 is generally hinged to the automatic vertical axis washer 10. As illustrated in FIGS. 2 and 3, the housing top 14 has a front region 22 and a rear region 24. The front region 22 includes an upper area 26, a middle area 28, and a lower area 30. The upper area 26 is generally horizontal. The middle area 28 slopes downwardly toward the interior of the wash tub, and the lower area 30 has a further downwardly sloping 32 and a generally horizontal surface 34. On the other hand, the rear region 24 includes an upper 36 and lower 38 surface. The upper 36 and lower 38 surfaces are generally planar, and the upper surface 36 is generally horizontal while the lower surface 38 is generally vertical.

Figure 7:
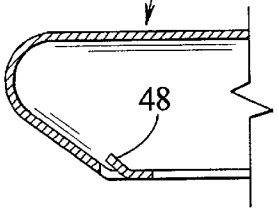
FIG. 7 illustrates a side sectional view of a front lid flange with barbed shaped

As illustrated in FIG. 1, the lid 18 includes a lid periphery 40. As further illustrated in FIGS. 1, 2, and 3, the lid 18 further includes a lid top 42, a front lid flange 44, and a rear lid flange 46. The front 44 and rear 46 lid flange extend along at least a portion of the lid periphery 40. As shown in greater detail in FIG. 7, the front lid flange 44 can be barbed 48 in shape.

As illustrated in FIG. 1, the lid seal 20 comprises a front lid seal 50 and a rear lid seal 52. The front lid seal 50 is elongated and has a length 54 and two ends 56. As better seen in FIGS. 2 and 3, the front lid seal 50 also includes a front lid seal clip 58 attachable to a front lid seal bulb 60.

Figure 5:
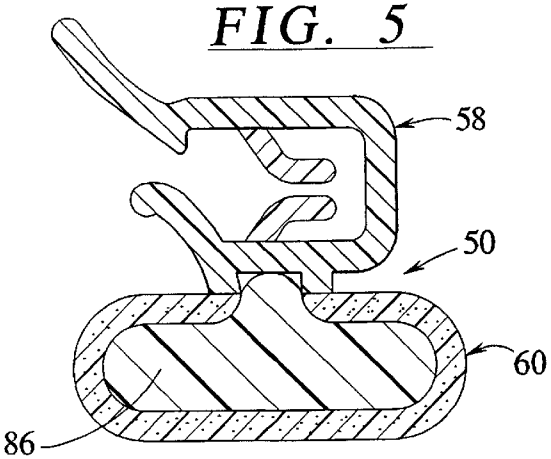
FIG. 5 illustrates a side sectional view of a front lid seal with an end plug.

As further illustrated in FIG. 4, the front lid seal clip 58 has an upper 62 and lower 64 end with a curved surface or bight 66 connecting the ends 62, 64 to form an open loop or U-shaped member 68. Inside the open loop 68, an upper finger 70 affixes to a top region or leg 72 and, a lower finger 74 attaches to a bottom region or leg 76. The upper 70 and lower 74 fingers extend along at least a portion of the length 54 of the front lid seal 50. Both the upper 70 and lower 74 fingers are flexible and can be formed of PVC or other material with similar flexible properties. On the other hand, the front lid seal bulb 60 has an end 78 that generally attaches to a front portion 79 of the bottom leg 76 of the front lid seal clip 58. The front lid seal bulb 60 has an opposite end 80 that attaches to a rear portion 81 of the bottom leg 76 of the front lid seal clip 58 to form a curved bulb surface 82 defining an open interior region 84. The curved bulb surface 82 extends along at least a portion of the length 54 of the front lid seal 50. As illustrated in FIG. 5, a molded end plug 86 is inserted adhesively or by a similar method of attachment into the front lid seal bulb 60 at both ends 56 of the front lid seal 50. The molded end plug 86 can be formed of PVC or other material with similar flexible or resilient qualities.

As illustrated in FIG. 1, the rear lid seal 52 is elongated and has a length 88 and two ends 90. As better illustrated in FIGS. 2 and 3, the rear lid seal 52 also includes a rear lid seal clip 92 attachable to a rear lid seal bulb 94. As further illustrated in FIG. 6, the rear lid seal clip 92 has a top 96 and a bottom 98 end joined by a curved surface forming a bight 100 and defining an open loop area 102. On the other hand, the rear lid seal bulb 94 has an end 104 that generally affixes to the top end 96 of the rear lid seal clip 92 and an opposite end 106 that attaches to the rear lid seal clip 92 at a distance spaced from the top end 96 to form a rear curved bulb surface 108 defining an open interior 110. The rear curved bulb surface 108 extends along at least a portion of the length 88 of the rear lid seal 52.

As illustrated in FIGS. 1, 2 and 3, the front lid seal 50 via the front lid seal clip 58 generally attaches to the front lid flange 44, and the rear lid seal 52 via the rear lid seal clip 90 generally attaches to the rear lid flange 46. Both the front lid seal 50 and rear lid seal 52 generally attach to the lid 18 extending along at least a portion of the lid periphery 40. No tools are needed to attach either the front lid seal 50 and the rear lid seal 52. In the embodiment as further illustrated in FIGS. 2 and 3, the upper 70 and lower 74 fingers of the front lid seal clip 58 engage the barbed flange 48 to securely affix the front lid seal 50 and the front lid flange 44.

As illustrated in FIG. 3, the front lid seal 50 and the rear lid seal 52 generally engage the housing top 14 when the lid is closed. In this position, both the front lid seal 50 and the rear lid seal 52 essentially eliminate or greatly reduce the gap between the lid 18 and the housing top 14 thereby eliminating or greatly reducing the level of operational noise or wash fluid spray escaping to the surrounding environment. In addition, the front lid seal 50 and rear lid seal 52 act to distribute and to cushion the contact between the lid 18 and the housing top 14 when the lid 18 is dropped into its closed position.

In particular, as illustrated in FIG. 3, the front lid seal bulb 60 along at least a portion of the curved bulb surface 82 flexibly compresses to engage and conform to the lower planar surface 34 of the front region 22 of the housing top 14. In doing so, the front lid seal bulb 60 effectively fills at least a portion at the lower region 30 to eliminate or greatly reduce gaps between the lid 18 and the housing top 14. Once the front lid seal bulb 60 fully compresses due to the weight of the lid 18, the lid 18 rests and is positioned such that the lid top 42 is essentially flushed with the upper region 26. As further illustrated in FIG. 3, the rear lid seal bulb 60 engages the lower surface 38 of the rear region 24 of the housing top 14 along at least a portion of the rear bulb curved surface 108. In doing so, the rear lid seal bulb 94 compresses to fill at least a portion of the void between the lid 18 and the rear housing top 24 in order to further eliminate or greatly reduce the gap between the lid 18 and the housing top 14.

In the embodiment as further illustrated in FIGS. 2, 3, 4 and 6, the front lid seal clip 58 and rear lid seal clip 92 are rigid and can be formed of nylon or other material with similar rigid qualities whereby both firmly attach to the lid 18. Likewise, the front lid seal bulb 60 and rear lid seal bulb 94 are flexible and resilient and can be formed of PVC or other material with similar flexible and resilient characteristics whereby both easily deform to effectively eliminate or greatly reduce gaps between the lid 18 and the automatic vertical axis washer 10 when the lid 18 is closed.

It should be understood that various changes and modifications to the presently preferred embodiments described herein will be apparent to those skilled in the art. For example, the lid seal 20 may exist as one continuous lid seal 20 extending along the entire lid periphery 40. The lid seal 20 may also be constructed as a single piece, rather than two constructed pieces, namely rigid and flexible, as illustrated. In addition, the lid seal 20 may attach to the lid 18 in a different manner than what is illustrated. For example, the lid seal 20 may attach to the lid 18 by using separate clip fasteners, threaded fasteners, adhesives, or by any other similar method of attachment. The lid seal 20 also may only extend along at least a portion of the front and the rear of the lid, or only extend along a portion of either the front or rear of the lid. Such changes and modifications may be made without departing from the spirit and scope of the present invention and without diminishing its attendant advantages. It is, therefore, intended that such changes and modifications be covered by the appended claims.

The embodiments of the invention in which an exclusive property or privilege is claimed are therefore defined as follows:

1. An automatic vertical axis washer with a clothes basket therein comprising:

a housing for enclosing said washer and having a housing top with an opening therein for providing access to said clothes basket;

a lid with a lid periphery hinged to said housing at said opening to move between an open position and a closed position;

said lid periphery sized to provide a gap between said lid and said housing top when said lid is in said closed position;

a lid seal attached to said lid and extending along at least a portion of said lid periphery; and said lid seal engaging said housing top when said lid is closed to substantially reduce said gap between said lid and said housing top.

2. An automatic vertical axis washer according to claim 1 wherein said lid comprises a front lid flange and a rear lid flange.

3. An automatic vertical axis washer according to claim 2 wherein said front lid flange is barbed in shape.

4. An automatic vertical washer according to claim 2 wherein said lid seal attaches to said front lid flange along at least a portion of said lid periphery.

5. An automatic vertical axis washer according to claim 2 wherein said lid seal attaches to said rear lid flange along at least a portion of said lid periphery.

6. An automatic vertical axis washer according to claim 1 wherein said lid seal comprises a front lid seal.

7. An automatic vertical axis washer according to claim 6 wherein said front lid seal comprises a front lid seal clip and a front lid seal bulb wherein said front seal clip attaches to said front lid seal bulb.

8. An automatic vertical axis washer according to claim 1 wherein said lid seal comprises a rear lid seal.

9. An automatic vertical washer according to claim 8 wherein said rear lid seal comprises a rear lid seal clip and a rear lid seal bulb wherein said rear lid seal clip attaches to said rear lid seal bulb.

10. An automatic vertical axis washer according to claim 1 wherein said lid seal comprises a front lid seal and a rear lid seal.

11. An automatic vertical axis washer with a clothes basket therein comprising:

a housing for enclosing said washer and having a housing top with an opening therein for providing access to said clothes basket;

a lid with a lid periphery hinged to said housing at said opening to move between an open position and a closed position;

said lid periphery sized to provide a gap between said lid and said housing top when said lid is in said closed position;

said lid further comprises a front lid flange and a rear lid flange;

a lid seal comprises a front lid seal and a rear lid seal;

said front lid seal being attached to said front lid flange along at least a portion of said lid periphery;

said rear lid seal being attached to said rear lid flange along at least a portion of said lid periphery; and said front lid seal and rear lid seal engaging said housing top when said lid is closed to substantially reduce said gap between said lid and said housing top.

12. An automatic vertical axis washer according to claim 11 wherein said front lid flange is barbed in shape.

13. An automatic vertical axis washer according to claim 11, further comprising:

said front lid seal having a front lid seal clip and a front lid seal bulb wherein said front lid seal clip attaches to said front lid seal bulb; and said rear lid seal having a rear lid seal clip and a rear lid seal bulb wherein said rear lid seal clip attaches to said rear seal lid bulb.

14. An automatic vertical axis washer according to claim 13, further comprising:

said front lid seal clip being attached to said front lid flange along at least a portion of said lid periphery; and said rear lid seal clip being attached to said rear lid flange along at least a portion of said lid periphery.

15. An automatic vertical axis washer with a clothes basket therein comprising:

a housing for enclosing said washer and having a housing top with an opening therein for providing access to said clothes basket;

a lid with a lid periphery hinged to said housing at said opening to move between an open position and a closed position;

said lid periphery sized to provide a gap between said lid and said housing top when said lid is in said closed position;

said lid further comprises a front lid flange and a rear lid flange;

a lid seal comprises a front lid seal and a rear lid seal;

said front lid seal comprises a front lid seal clip and a front lid seal bulb wherein said front lid seal clip attaches to said front lid seal bulb;

said rear lid seal comprises a rear lid seal clip and a rear lid seal bulb wherein said rear lid seal clip attaches to said rear lid seal bulb;

said front lid seal clip being attached to said front lid flange along at least a portion of said lid periphery;

said rear lid seal clip being attached to said rear lid flange along at least a portion of said lid periphery; and said front lid seal and rear lid seal engaging said housing top when said lid is closed to substantially reduce said gap between said lid and said housing top.

16. An automatic vertical axis washer according to claim 15, wherein said front lid flange is barbed in shape.

17. An automatic vertical axis washer according to claim 15, wherein said front lid clip and said rear lid clip are rigid, whereby both firmly affix to said lid without additional fasteners.

18. An automatic vertical axis washer according to claim 15, wherein said front lid bulb and said rear lid bulb are flexible, whereby both act to substantially reduce said gap between said lid and said automatic vertical axis washer.

* * * * *